US006694709B2

(12) United States Patent
Takahashi et al.

(10) Patent No.: US 6,694,709 B2
(45) Date of Patent: Feb. 24, 2004

(54) APPARATUS TO CHARGE AND SEAL IN CONTENTS

(75) Inventors: Masashi Takahashi, Kashiwa (JP); Tetsuo Yoshiwara, Matsudo (JP)

(73) Assignee: Nippon Tansan Gas Co., Ltd., Tokyo (JP)

( * ) Notice: Subject to any disclaimer, the term of this patent is extended or adjusted under 35 U.S.C. 154(b) by 0 days.

(21) Appl. No.: 10/242,078

(22) Filed: Sep. 12, 2002

(65) Prior Publication Data

US 2003/0136091 A1 Jul. 24, 2003

(30) Foreign Application Priority Data

Jan. 22, 2002 (JP) ..... 2002-012358

(51) Int. Cl.[7] ..... B65B 31/00

(52) U.S. Cl. ..... 53/510; 53/79; 53/89; 53/107; 53/109

(58) Field of Search ..... 53/510, 403, 408, 53/432, 79, 89, 107, 109

(56) References Cited

U.S. PATENT DOCUMENTS 1,931,911 A * 10/1933 White ..... 53/408
1,992,556 A * 2/1935 Tone ..... 53/432
2,496,877 A * 2/1950 Krueger ..... 53/510
3,255,568 A * 6/1966 Martin et al. ..... 53/510
3,486,295 A * 12/1969 Rausing et al. ..... 53/510
4,148,933 A * 4/1979 Janovtchik ..... 53/408
4,154,044 A * 5/1979 Lang ..... 53/510
4,707,213 A * 11/1987 Mohr et al. ..... 53/510
4,909,022 A * 3/1990 Kubis et al. ..... 53/510
5,323,589 A * 6/1994 Linner ..... 53/510
5,509,252 A * 4/1996 Gorlich ..... 53/510
6,230,472 B1 * 5/2001 Stahlecker ..... 53/426

* cited by examiner

*Primary Examiner*—John Sipos
*Assistant Examiner*—Louis Huynh
(74) *Attorney, Agent, or Firm*—Koda & Androlia

(57) ABSTRACT

An apparatus to charge and seal in contents is provided with a supporting portion for containers, holding portions for seal plugs, airtight chambers, a pressure gas supplier and a vacuum pump. The container has a receiving chamber and it is to be put on the supporting portion being the chamber is charged with contents and being the chamber's opening portion faced upward. The seal plug is for sealing the opening portion. The airtight chamber is composed of a main portion and a cap portion. The main and cap portions freely move relatively and freely contact tightly, then they surround the supporting and the holding portions in airtight condition. Further, the supporting portion and the main portion freely move relatively in airtight condition, so as the holding portion and the cap portion do, and the supporting portion and the holding portion are freely separated from each other.

6 Claims, 3 Drawing Sheets

APPARATUS TO CHARGE AND SEAL IN CONTENTS

BACKGROUND OF THE INVENTION

1. Technical Field of the Invention

This invention relates to apparatuses to charge pressurized gas with other kind of contents except gas into containers, especially, relates to apparatuses to charge and seal in contents which apparatuses charge such contents as raw powder materials, raw liquid materials, raw solid materials and so on to be solved into and drunk as liquid, into receiving chambers of bottle caps with pressurized gas to avoid the contents from deterioration caused by contacting with air.

2. Prior Art

Recently, drink charged in a bottle like a plastic bottle (bottled drink) is widely spread. However, most of these bottled drinks are mixture of liquid and raw material, and because the raw material causes deterioration (oxidation etc.) under the influence of air temperature, ultraviolet rays, oxygen in air and so on, there is a problem that it is difficult to keep freshness of produced moment. Therefore, the inventor of present invention has developed such bottle caps that has receiving chamber to receive raw material and pressurized gas as disclosed in patent application JP2001-185428. According to this bottle caps, raw material is received with pressurized gas into receiving chamber sealed up with seal plug, and because the receiving chamber is opened by opening means when consumer use it, it is possible to supply bottled drinks made from raw materials and liquid to the consumer keeping freshness of produced moment without causing deterioration of raw material.

On the other hand, as an example of an art to charge pressurized gas and seal it up with seal plugs, there is a technique of charging into gas cartridges which technique is owned by the present applicant. According to this technique of charging, charge inlet of vessel corresponding to the container is settled in airtight chamber, and after pressurized gas corresponding to the contents is filled into the airtight chamber wherein the pressurized gas is charged into the vessel, the charge inlet is welded with a seal plug and a vessel having sealed structure can be made.

However, by the above technique of charging, it is impossible to charge any contents except gases. Further, by using other ordinary technique to charging, it is impossible to charge both of the raw material and the pressurized gas effectively into the above bottle cap having the receiving chamber.

Accordingly, the present invention aims to provide an apparatus to charge and seal in contents which apparatus enable to charge pressurized gas with other contents except gases into container and seal them in, and enable to charge raw powder material, raw liquid material, or raw solid material to be solved into and drunk as liquid into the bottle cap having the receiving chamber with pressurized gas.

SUMMARY OF THE INVENTION

An apparatus to charge and seal in contents which apparatus relates to present invention is characterized in that at least one supporting portion whereon at least one container having a receiving chamber with an opening portion which chamber is charged with contents is to be put being the opening portion faced upward, at least one holding portion for a seal plug to seal the opening portion, at least one airtight chamber which surrounds the supporting portion and the holding portion in airtight condition, and a pressure gas supply means and a vacuum forming means each of which means is respectively connected to inside of the airtight chamber via an on-off valve are provided, the airtight chamber is composed of a main portion and a cap portion both of which portions are freely move relatively and freely contact tightly, the supporting portion and the main portion freely move relatively in airtight condition, so as the holding portion and the cap portion do, and the supporting portion and the holding portion are freely separated from each other.

According to present apparatus to charge and seal in contents, by charging pressurized gas into the container having been charged with contents and by fixing the seal plug on which container at its opening portion, it is possible to seal the contents with pressurized gas in the container. Here, sealing can be achieved by following processes.

First of all, the container having the receiving chamber with opening portion which chamber has been charged with the contents is put on the supporting portion being the opening portion faced upward. In this case, as the opening portion is faced upward the contents are prevented from being spilt. Regarding the seal plug to seal the opening portion, it is held by the holding portion and kept there.

Then, the main portion and the cap portion move to close each other whereby the cap portion contacts tightly to the main portion, and the airtight chamber is formed which chamber surrounds the supporting portion and the holding portion in airtight condition. Here, as the airtight chamber is composed of the main portion and the cap portion which portions are separated, at starting of successive sealing processes the container and the seal plug are able to be set easily on the supporting portion and the holding portion which portions are settled inside the airtight chamber.

Then, after air existing inside the airtight chamber is removed by the vacuum forming means the pressurized gas is filled into the airtight chamber by the pressure gas supply means, and the pressurized gas is charged into the receiving chamber of the container.

When charging of the pressurized gas is completed the supporting portion and the holding portions move in direction to close each other, and the seal plug is fixed on the opening portion. When fixing of the seal plug is completed the supporting portion and the holding portion move in direction to be apart from each other, and the main portion and the cap portion separate as last process to end successive actions. Then sealing processes are finished. Here, as the airtight chamber is opened in the air it can be easily done to take out the container sealed up and to set another container to be sealed up next.

Preferably, the supporting portion may have a denting portion on setting surface for the container in which portion the container fits, and the holding portion may have a denting portion on holding surface for the seal plug in which portion the seal plug fits.

In this case, by forming the denting portions on proper positions, they can be used as means to define positions of the container and the seal plug. Therefore, the container and the seal plug are set in proper relative position only by setting them to fit in the respective denting portions, and then fixing of the seal plug on the opening portion is smoothly conducted.

Preferably, the holding portion may have a through hole opened on the holding surface for the seal plug contacts tightly and the through hole may be connected to the second vacuum forming means.

In this case, by lowering pressure of the through hole by the second vacuum forming means, the seal plug is held on the holding portion utilizing atmospheric pressure. However, the pressure of the through hole is required to be lower than the pressure achieved by removing air existing inside the airtight chamber by the vacuum forming means.

Preferably, the cap portion may be supported by axis member to stable side being able to sway freely and may be able to get freely out of axis line of the supporting portion toward direction where axis line of the cap portion makes angle to the axis line of the supporting portion.

In this case, the cap portion and the holding portion which portions are at positions of facing to the supporting portion at sealing processes are able to get out of their positions in case of need. Therefore, setting or taking out the seal plug and the container are easily conducted. Here, though the holding portion and the cap portion are able to move freely relatively in airtight condition, freely moving of the holding portion means moving in direction where it gets closer or further to the supporting portion, that is, in condition where the holding portion is at position of facing to the supporting portion it is able to move freely along axis line of itself which line lays in same direction as axis line of the supporting portion. Therefore, it is to move together with the cap portion in other directions, and in case axis line of the cap portion gets out of the axis line of the supporting portion toward direction where it makes angle to the axis line of the supporting portion, the holding portion is also to get out of the position where it facing to the supporting portion.

Preferably, the cap portion may be fixed on a board set straying from axis and having arms, and the another ends of the arms are fixed to the axis member.

In this case, as escape distance by which the cap portion and the holding portion get out of the supporting portion can be made longer, setting and taking out the seal plug and the container are more easily conducted.

The cap portion may be made of resin.

In this case, by giving the cap portion elasticity, it is possible to enhance tightness of contacting between the main portion and the cap portion.

The container may be bottle cap and the receiving chamber is for receiving raw material and pressurized gas.

In this case, being chosen as the contents, such materials that raw powder material, raw liquid material, or raw solid material to be solved into and drunk as liquid can be charged with pressurized gas into the bottle cap in condition being isolated from the liquid.

DETAILED DESCRIPTION OF THE PREFERRED EMBODIMENT

Figure 1:
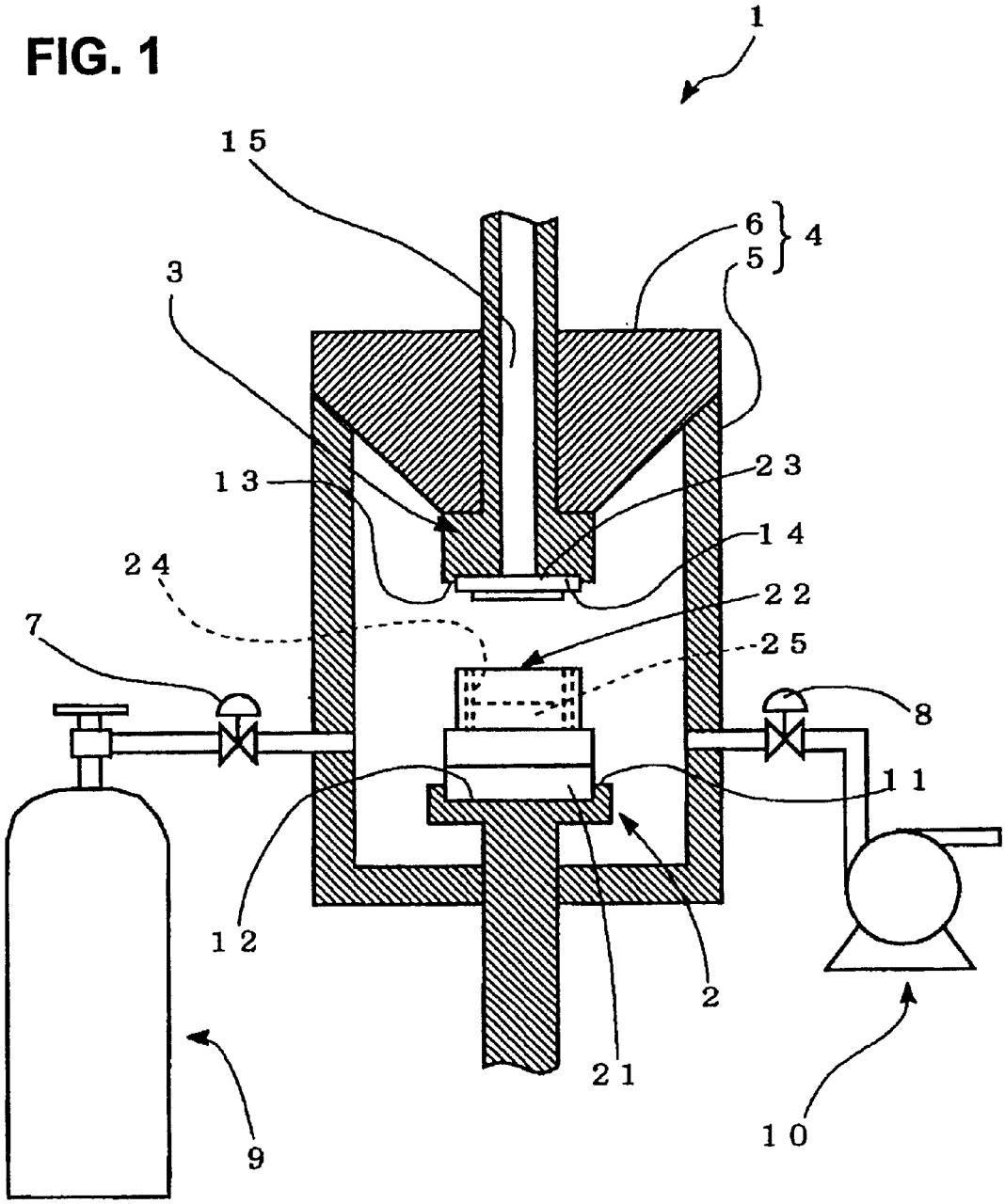
FIG. 1 is a front section showing enlarged main parts of an apparatus to charge and seal in contents which apparatus is in respect of the present invention.

An apparatus 1 to charge and seal in contents is provided with a supporting portion 2 whereon containers 21 are to be put, holding portions 3 for seal plugs 23, airtight chambers 4 each of which surrounds the supporting portion 2 and the holding portion 3 in airtight condition, and a pressure gas supply means 9 and a vacuum forming means 10 each of which means is respectively connected to inside of the airtight chambers 4 via on-off valves 7,8. The container 21 has a receiving chamber 24 having an opening portion 22, which chamber is charged with contents 25, is to be put on the supporting portion 2 being the opening portion 22 faced upward. The seal plug 23 is for sealing the opening portion 22. The airtight chamber 4 is composed of a main portion 5 and a cap portion 6 and the main portion 5 and the cap portion 6 freely move relatively and freely contact tightly. Further, the supporting portion 2 and the main portion 5 freely move relatively in airtight condition, so as the holding portion 3 and the cap portion 6 do, and the supporting portion 2 and the holding portion 3 are freely separated from each other.

According to present apparatus 1 to charge and seal in contents, by charging pressurized gas into container 21 having been charged with contents 25 and by fixing the seal plug 23 on which container at its opening portion 22, it is possible to seal the contents 25 with pressurized gas in the container 21. Here, sealing can be achieved by following processes.

First of all, the container 21 having the receiving chamber 24 with opening portion 22 which chamber has been charged with the contents 25 is put on the supporting portion 2 being the opening portion 22 faced upward. In this case, as the opening portion 22 is faced upward the contents 25 are prevented from being spilt. Here, the contents 25 is charged by another charging apparatus not shown in the figures. Then the containers 21 having been charged with 25 are set by hand, however, they may be automatically set by using ordinary arts. Regarding the seal plug 23 to seal the opening portion 22, it is held by the holding portion 3 and kept there. Here, in FIG. 2(*a*), cross marks means the on-off valve 7 or 8 is closed.

Then, the main portion 5 and the cap portion 6 move to close each other whereby the cap portion 6 contacts tightly to the main portion 5, and the airtight chamber 4 is formed which chamber surrounds the supporting portion 2 and the holding portion 3 in airtight condition. Here, as the airtight chamber 4 is composed of the main portion 5 and the cap portion 6 which portions are separated, at starting of successive sealing processes, as shown in FIG. 2(*a*) the container 21 and the seal plug 23 are easily set easily on the supporting portion 2 and the holding portion 3 which portions are settle inside the airtight chamber 4.

Figure 2A:
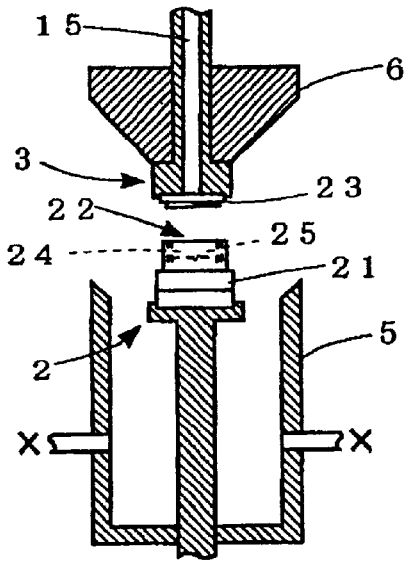
FIG. 2 shows working condition of the main part of the apparatus enlarging the main part, and 2(*a*) is a front section showing first condition where seal plugs and containers are set, 2(*b*) is a front section of condition where the seal plugs are fixed on opening portions at inside of airtight chamber, and 2(*c*) is a front section of condition where successive actions are completed and sealing the containers is finished.
Figure 2B:
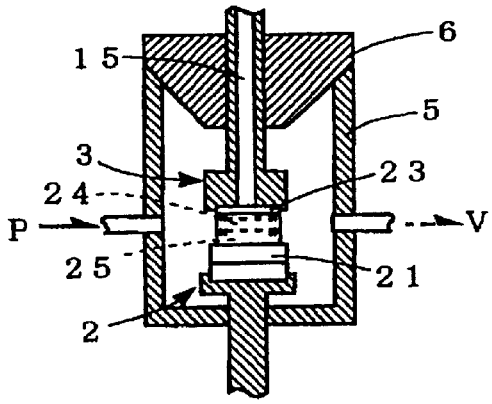
Figure 2C:
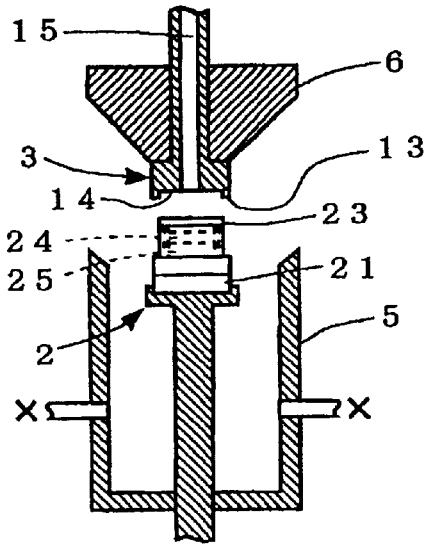

Then, after air existing inside the airtight chamber 4 is removed (as shown with arrow V in FIG. 2(*b*)) with the vacuum forming means 10 the pressurized gas is filled into the airtight chamber 4 (as shown with arrow P in FIG. 2(*b*)) by the pressure gas supply means 9, and the pressurized gas is charged into the receiving chamber 24 of the container 21. Here in FIG. 2(*b*), although the arrow V and the arrow P are showed equally for convenience of explanation, the on-off valves 7 and 8 are not to be opened at same time in actual.

When charging of the pressurized gas is completed the supporting portion 2 and the holding portions 3 move in direction to close each other, and the seal plug 23 is fixed on the opening portion 22 as showed in FIG. 2(*b*). When fixing of the seal plug 23 is completed the supporting portion 2 and the holding portion 3 move in direction to be apart from each other, and the main portion 5 and the cap portion 6 separate as last process to end successive actions as showed in FIG.

2(*c*). Then sealing processes are finished. Here, as the airtight chamber 4 is opened in the air it can be easily done to take out the container 21 sealed up and to set another container to be sealed up next.

The supporting portion 2 has a denting portion 12 on setting surface 11 for the container 21 in which portion the container 21 fits. Further, the holding portion 3 has a denting portion 14 on holding surface 13 for the seal plug 23 in which portion the seal plug 23 fits.

To do like this, by forming the denting portions 12 and 14 on proper positions, they can be used as means to define positions of the container 21 and the seal plug 23. Therefore, the container 21 and the seal plug 23 are set in proper relative position only by setting them to fit in the respective denting portions 12 or 14, and then fixing of the seal plug 23 on the opening portion 22 is smoothly conducted.

The holding portion 3 has a through hole 15 opened on the holding surface 13 for the seal plug 13 contacts tightly and the through hole 15 is connected to the second vacuum forming means not shown in the figures.

To do like this, by lowering pressure of the through hole 15 by the second vacuum forming means, the seal plug 23 is held on the holding portion utilizing atmospheric pressure. However, the pressure of the through hole 15 is required to be lower than the pressure achieved by removing air existing inside the airtight chamber 4 by the vacuum forming means 10.

The holding portion 3 has a structure wherein it is able to be moved along axis line of itself which line lays in same direction as axis line M of the supporting portion 2 in condition where it is at position of facing to the supporting portion 2, however, it is to move together with the cap portion 6 in other directions. Regarding the cap portion 6, it is supported by axis member 31 to stable side 32 being able to sway freely and is able to get freely out of the axis line M of the supporting portion 2 toward direction where axis line L of the cap portion 6 makes angle to the axis line M of the supporting portion 2.

To do like this, the cap portion 6 and the holding portion 3 which portions are at positions of facing to the supporting portion 2 at sealing process can be got out of their positions in case of need. Therefore, setting or taking out of the seal plug 23 and the container 21 can be easily conducted.

Further, the cap portion 6 is fixed on a board 34 set straying from axis and having arms 33, and the another ends of the arms 33 are fixed to the axis member 32.

To do like this, as escape distance by which the cap portion 6 and the holding portion 3 get out of the supporting portion 2 can be made longer, setting and taking out the seal plug 23 and the container 21 are more easily conducted.

The cap portion 6 is made of resin.

To do like this, by giving the cap portion 6 elasticity, it is possible to enhance tightness to contacting between the main portion 5 and the cap portion 6.

Figure 3A:
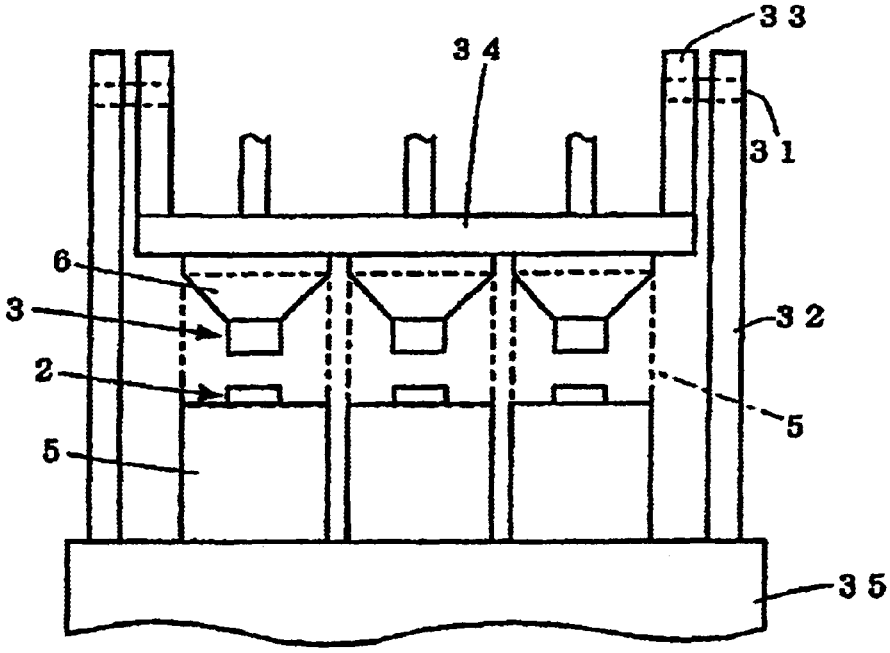
FIG. 3 is a rough view of main part of the apparatus, and 3(*a*) is a front view, 3(*b*) is a side view.
Figure 3B:
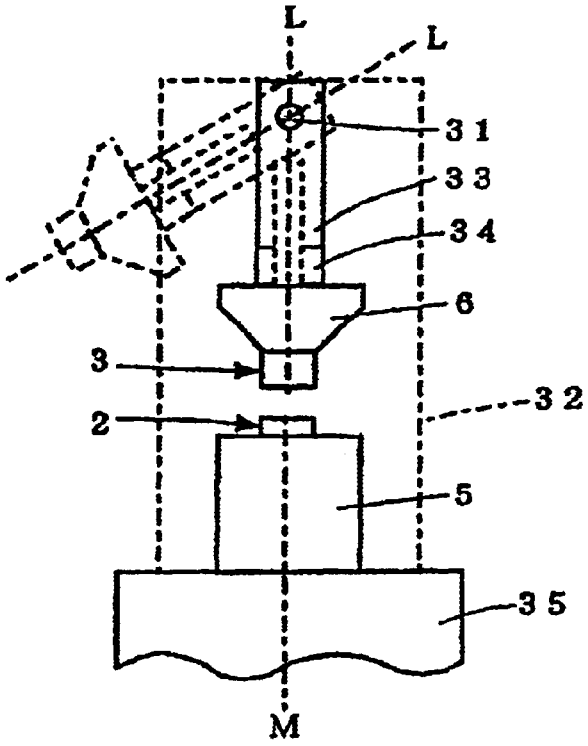

Inside basement 35 of the stable side 32 driving portion not shown in figures which portion makes the main portion 5 move in forward and backward is settled. Then, the main portion 5 is, at processes of setting or taking out the seal plug 23 and the container 21, to move to downward position as shown in FIG. 3(*a*) with a solid line, and at sealing up process, to move upward position as shown in same figure with a broken line.

The containers 21 are bottle caps. Then the receiving chamber 24 is for receiving raw material and pressurized gas, and the contents is material to be solved into and drunk as liquid. For the material, there is no limitation about its form and any one of powder, liquid or solid is allowable.

According to this apparatus 1 to charge and seal in contents, raw materials can be charged with pressurized gas into the bottle cap in condition being isolated from the liquid. Here, the container 21 needed not to be bottle caps, but other containers are also allowed as far as having opening portion to be sealed with the seal plugs and being able to be set on the supporting portion 2.

According to present apparatus to charge and seal in contents, by charging pressurized gas into container having been charged with contents and by fixing the seal plug on which container at its opening portion, it is possible to seal the contents with pressurized gas in the container.

According to present invention, by forming the denting portions on proper positions, they can be used as means to define positions of the container and the seal plug. Therefore, the container and the seal plug are set in proper relative position only by setting them to fit in the respective denting portions, and then fixing of the seal plug on the opening portion is smoothly completed.

According to present invention, by lowering pressure of the through hole by the second vacuum forming means, the seal plug is held on the holding portion utilizing atmospheric pressure.

According to present invention, the cap portion and the holding portion which portions are at positions of facing to the supporting portion at sealing processes can be got out of their positions in case of need. Therefore, setting or taking out the seal plug and the container can be easily conducted.

According to present invention, as escape distance by which the cap portion and the holding portion get out of the supporting portion can be made longer, setting and taking out the seal plug and the container are more easily conducted.

According to present invention, by giving the cap portion elasticity, it is possible to enhance tightness of contacting between the main portion and the cap portion.

According to present invention, being chosen as the contents, such materials that raw powder material, raw liquid material, or raw solid material to be solved into and drunk as liquid can be charged with pressurized gas into the bottle cap in condition being isolated from the liquid.

What is claimed is:

1. An apparatus to charge and seal in contents in at least one container, said apparatus comprising:

at least one airtight chamber defined by a main portion having an upper opening and a cap portion for engaging said upper opening, wherein said main portion and said cap portion are freely movable relative to each other;

at least one supporting portion disposed in said airtight chamber and freely movable with respect to the main portion in an airtight condition, wherein said at least one container having a receiving chamber with an opening portion faced upward is supported on a supporting surface of said supporting portion;

at least one holding portion disposed in said airtight chamber and freely movable with respect to said cap portion in an airtight condition, wherein a seal plug for sealing the opening portion of said at least one container is held on a holding surface of said holding portion;

a pressurized gas supply means and a vacuum forming means selectively connected to the airtight chamber via an on-off valve attached to said main portion; and wherein:

said supporting portion and said holding portion are freely separable from each other;

said cap portion is pivotally mounted to vertical side frames and is able to sway freely out of an axis line of the supporting portion toward a direction where an axis line of the cap portion makes an angle to the axis line of the supporting portion, said cap portion is fixedly mounted on a board, said board is set straying from the axis member and attached to a pair of suspension arms, the free ends of the suspension arms are pivotally affixed to the axis members; and said cap portion is made of resin.

2. The apparatus to charge and seal in contents as claimed in claim 1, wherein said supporting surface of said supporting portion has a denting portion sized to fit the at least one container, and said holding surface of said holding portion has a denting portion to fit the seal plug.

3. The apparatus to charge and seal in contents as claimed in claim 1 or 2, wherein said holding portion has a through hole opened on the holding surface, and the through hole is connected to a second vacuum forming means.

4. The apparatus to charge and seal in contents as claimed in claim 3, wherein the at least one container is bottle cap and the receiving chamber of the container is for receiving raw material and pressurized gas.

5. The apparatus to charge and seal in contents as claimed in claim 1 or 2, wherein the at least one container is bottle cap and the receiving chamber of the container is for receiving raw material and pressurized gas.

6. The apparatus to charge and seal in contents as claimed in claim 1 or 2, wherein said upper opening of said main portion has an inwardly inclined surface and said cap portion is conical in solid shape for engaging with said inwardly inclined surface of said main portion.

* * * * *